US010780465B2

(12) United States Patent
Bartelmuss

(10) Patent No.: US 10,780,465 B2
(45) Date of Patent: Sep. 22, 2020

(54) APPARATUS FOR CLEANING A FELT IN A SYSTEM FOR PRODUCING A PAPER WEB

(71) Applicant: Klaus Bartelmuss, Teufenbach (AT)

(72) Inventor: Klaus Bartelmuss, Teufenbach (AT)

( * ) Notice: Subject to any disclaimer, the term of this patent is extended or adjusted under 35 U.S.C. 154(b) by 319 days.

(21) Appl. No.: 15/587,532

(22) Filed: May 5, 2017

(65) Prior Publication Data

US 2018/0009008 A1 Jan. 11, 2018

(30) Foreign Application Priority Data

Jul. 7, 2016 (AT) ..... 320/2016

(51) Int. Cl.

| | |
|---|---|
| ***B08B 5/04*** | (2006.01) |
| ***D21F 7/12*** | (2006.01) |
| ***D21F 1/52*** | (2006.01) |
| ***B08B 3/04*** | (2006.01) |
| *D21F 1/32* | (2006.01) |

(52) U.S. Cl.

CPC ..... *B08B 5/046* (2013.01); *B08B 3/041* (2013.01); *D21F 1/52* (2013.01); *D21F 7/12* (2013.01); *B08B 2215/006* (2013.01); *B65H 2406/31* (2013.01); *D21F 1/32* (2013.01)

(58) Field of Classification Search

CPC . B08B 5/046; B08B 3/041; D21F 7/12; D21F 1/52; B65H 2406/31

See application file for complete search history.

(56) References Cited

U.S. PATENT DOCUMENTS 3,005,490 A * 10/1961 Justus ..... D21F 1/48 162/252
3,159,377 A * 12/1964 Samour ..... F16K 7/10 137/375
3,394,914 A * 7/1968 Takamitsu ..... F16K 1/2285 137/375
3,859,163 A * 1/1975 Haythornthwaite ..... D21F 1/32 134/15
4,058,435 A * 11/1977 Williams, Jr. ..... D21F 3/10 162/371
4,547,266 A * 10/1985 Keller ..... D21F 1/52 162/252

(Continued)

FOREIGN PATENT DOCUMENTS

CN 1237216 A 12/1999
CN 1523163 A 8/2004

(Continued)

*Primary Examiner* — Joseph L. Perrin
*Assistant Examiner* — Kevin G Lee
(74) *Attorney, Agent, or Firm* — Laurence A. Greenberg; Werner H. Stemer; Ralph E. Locher

(57) ABSTRACT

An apparatus for cleaning a felt in a system for producing a paper web has a device for introducing a cleaning liquid into the felt and at least one following suction device in the direction of movement of the felt and having a vacuum duct, through which the cleaning liquid is suctioned out of the felt. The suction device between the vacuum duct and the felt is formed with suction ducts, through which the cleaning liquid in the felt is suctioned away. At least one of the suction ducts is assigned an inflatable valve element. In the inflated state of the valve element the suction duct is closed and in its ventilated state the suction duct is opened.

12 Claims, 6 Drawing Sheets

(56) References Cited

U.S. PATENT DOCUMENTS

| | | | | |
|---|---|---|---|---|
| 5,016,856 | A * | 5/1991 | Tartaglino | F16K 7/10 137/907 |
| 5,147,508 | A | 9/1992 | Sweet | |
| 5,718,806 | A | 2/1998 | Trokhan et al. | |
| 6,138,564 | A * | 10/2000 | Eckardt | B65H 23/245 101/228 |
| 6,221,215 | B1 * | 4/2001 | Halmschlager | D21F 1/523 162/217 |
| 6,253,983 | B1 | 7/2001 | Dadd | |
| 7,175,744 | B2 | 2/2007 | Bartelmuss et al. | |
| 2002/0170694 | A1 | 11/2002 | Graf | |
| 2002/0175477 | A1 * | 11/2002 | Schrefl | D21F 3/10 277/552 |
| 2003/0094255 | A1 | 5/2003 | Bartelmuss et al. | |
| 2013/0042987 | A1 | 2/2013 | Cabrera | |
| 2017/0002516 | A1 | 1/2017 | Canali et al. | |

FOREIGN PATENT DOCUMENTS

| | | | |
|---|---|---|---|
| DE | 102004014843 | A1 | 10/2005 |
| DE | 102007040146 | A1 | 2/2009 |
| EP | 1076131 | A2 | 2/2001 |
| JP | S5623798 | U | 3/1981 |
| SU | 1002442 | A1 * | 3/1983 |
| TW | 201311968 | A | 3/2013 |
| WO | 2015097682 | A1 | 7/2015 |

* cited by examiner

APPARATUS FOR CLEANING A FELT IN A SYSTEM FOR PRODUCING A PAPER WEB

CROSS-REFERENCE TO RELATED APPLICATION

This application claims the priority, under 35 U.S.C. § 119, of Austrian patent application A 320/2016, filed Jul. 7, 2016; the prior application is herewith incorporated by reference in its entirety.

BACKGROUND OF THE INVENTION

Field of the Invention

The present invention relates to an apparatus for cleaning a felt in a system for producing a paper web. The apparatus has a device for introducing a cleaning liquid into the felt and at least one following suction device in the direction of movement of the felt and a vacuum duct, through which the cleaning liquid is suctioned out of the felt. The suction device between the vacuum duct and the felt is formed with suction ducts, through which the cleaning liquid in the felt is suctioned away.

Systems for producing paper webs contain a first area with at least one wire, to which a stock mixture for forming a paper web is applied, the wire being assigned suction boxes formed with foils, by which water is suctioned away out of the stock mixture, by which means the paper web is produced. These systems also contain a second area with felts, in which the paper web and at least one felt are led through between press rolls, by which means moisture in the paper web is picked up by the felts, and in addition a third area, in which the paper web is dried by way of drying cylinders. Further on, the dried paper web is wound onto spools, subdivided into sheets and packed in cartons.

Since the felts not only pick up moisture contained in the paper web but constituents of the stock mixture, i.e., pulp, in particular fiber material, also get into the same, as a result of which the effectiveness of the felts is impaired, there is the requirement to provide apparatuses for cleaning the felts in the movement path of the same. These apparatuses comprise at least one device for introducing a cleaning liquid into the felts and at least one following suction device in the direction of movement of the felts, by way of which the cleaning liquid in the felts is suctioned away at the same time as the foreign materials located in the latter. The suction device comprises a vacuum duct and a suction plate, on which the felt rests and over which the felt is guided. The suction plate is formed with suction ducts. The ducts are formed, for example, by multiple slots extending transversely with respect to the felt and located beside one another in the direction of movement of the felt or by a plurality or a multiplicity of openings in the suction plate, in particular bore holes.

During the operation of such a suction device, however, it happens that the felts cannot be cleaned completely of the foreign materials located in the same, as a result of which, over the course of the operating time, they contain more and more foreign materials. As a consequence, they become increasingly non-permeable for the extraction of the cleaning liquid. A felt that is new and thus contains no foreign materials is so permeable that the required minimum vacuum in the vacuum duct can be produced only when only a few suction ducts are provided in the suction plate for the extraction of the liquid, or the total cross section of the suction ducts is low.

With increasing operating time of the felt and therefore increasing loading of the felt by foreign materials, however, the permeability of the felt is reduced, for which reason that region of the felt on which the suction force acts must be enlarged. This is effected by the total cross section of the effective suction ducts being enlarged.

According to the known prior art, the suction plates are formed with suction ducts of which the total cross section is so large that, even in the case of a felt that is highly loaded with foreign materials, the necessary suction force acts on the felt. However, in order to be able to maintain the vacuum in the vacuum duct required for the operation with a felt that is new and therefore free of foreign materials, the suction ducts in the suction plate are initially partly closed and, with the increasing loading of the felt and therefore decreasing permeability of the felt, the initially closed suction ducts are successively opened.

For this purpose, it is known to assign sealing strips to some of the suction ducts located in the suction plate, by which sealing strips the suction ducts are initially partly closed, the sealing strips being removed successively with increasing operating time. Known felts have a width of up to 12 m. Suction ducts in suction plates have a width of, for example, 10 mm to 18 mm. Sealing strips which consist of polyethylene, for example, have a length, for example, of up to 12 m and a cross section of 10 mm to 18 mm×20 mm.

However, there is the difficulty that, during the operation of the system, it is therefore not possible to remove these sealing strips since, because of the vacuum prevailing in the suction device, they are pressed against the suction plate with very great pressure and since they are stuck to the suction plate by the foreign materials removed from the felt by means of the cleaning liquid.

It is also further known to provide two suction devices following each other. Only one of the same is initially connected. Once the wire becomes highly loaded with foreign materials, the second suction device is also connected.

SUMMARY OF THE INVENTION

It is accordingly an object of the invention to provide a device for cleaning a felt in a paper-web making facility which overcomes the above-mentioned and other disadvantages of the heretofore-known devices and methods of this general type and to provide a suction device in which, during the operation of the system, individual suction ducts which are initially closed can be opened and also closed during the operation without difficulty.

With the foregoing and other objects in view there is provided, in accordance with the invention, an apparatus for cleaning a felt in a system for producing a paper web, the apparatus comprising:

a device for introducing a cleaning liquid into the felt;

at least one suction device disposed downstream of said device in a direction of movement of the felt, said suction device having a vacuum duct, through which the cleaning liquid is suctioned out of the felt;

said suction device having suction ducts formed therein between said vacuum duct and the felt for suctioning the cleaning liquid away from the felt; and an inflatable valve element assigned to at least one of said suction ducts, said inflatable valve element having an inflated state wherein said at least one suction duct is closed and a ventilated state wherein said at least one suction duct is opened.

In other words, the objects of the invention are achieved in that at least one of the suction ducts is assigned at least one inflatable valve element, in the inflated state of which the suction duct is closed and by the ventilated, or deflated, state of which the suction duct is opened.

Preferably, the suction duct is formed as a slot oriented transversely with respect to the felt, and the valve element is formed as an inflatable hose, the suction duct extending over the width of the felt.

The suction duct can also be formed by at least two slots oriented transversely with respect to the felt and adjoining one another, or by openings, in particular drilled holes.

According to a preferred embodiment, at least one suction plate which is formed with suction ducts and which extends transversely with respect to the felt is fixed to the suction device. Furthermore, the at least one valve element, which in particular is formed as a hose, is preferably formed with a projecting strip, by means of which it is clamped between the housing of the vacuum duct and the suction plate.

Furthermore, between the housing of the vacuum duct and the suction plate, it is possible to provide at least one supporting strip for the at least one valve element, which in particular is formed as a hose, to which supporting strip the valve element is fixed. The valve element can be fixed to the supporting strip by adhesive bonding.

According to a further embodiment, at least one valve plate, to which a valve element, in particular a hose, is fixed, is supported on the supporting strip and is adjustable by the valve element, wherein said valve plate can be pivoted by the inflatable valve element into the position closing the associated suction opening. Furthermore, the supporting strip can be screwed to the housing of the vacuum duct. Furthermore, the suction plate and the supporting strips can be formed with tongues and grooves assigned to one another, by means of which they are fixed to each other. The tongues and grooves are preferably oriented transversely with respect to the felt, by which means the suction plate is displaceable transversely with respect to the felt.

Other features which are considered as characteristic for the invention are set forth in the appended claims.

Although the invention is illustrated and described herein as embodied in an apparatus for cleaning a felt in a system for producing a paper web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
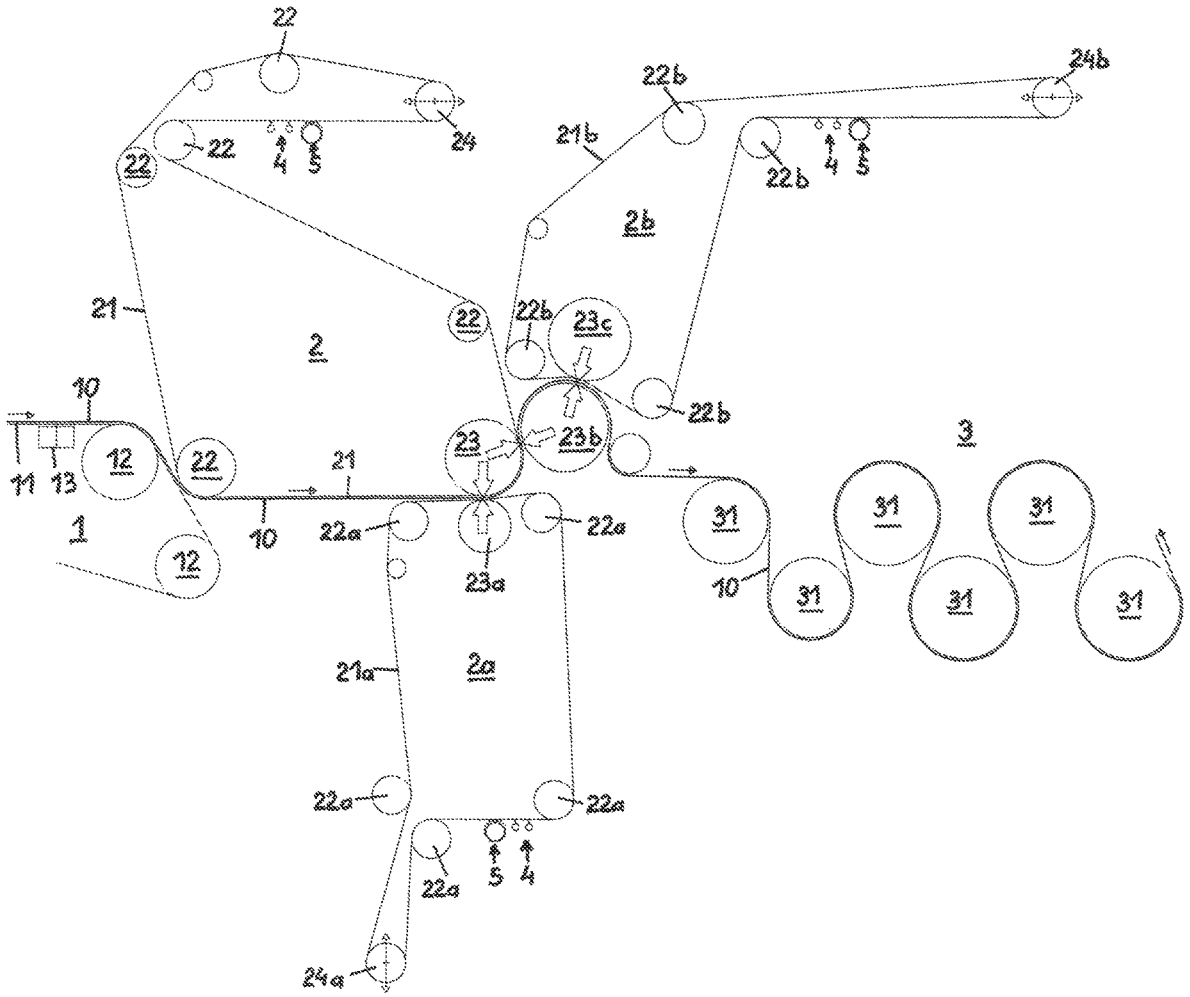
FIG. 1 shows a schematic illustration of a system for producing a paper web.

Referring now to the figures of the drawing in detail and first, particularly, to FIG. 1 thereof, there is shown system for producing a paper web. The apparatus has a first system part 1, in which an intrinsically closed wire 11 is guided over deflection rolls 12 and suction boxes 13 that are assigned to the wire 11. On the wire 11 there is a stock material, or pulp, for producing a paper web 10. Water is extracted from the stock material through the suction boxes 13.

Since the system part 1 is not critical for the present invention, only its end region is illustrated in the drawing. The first system part 1 is adjoined by a second system part 2, 2*a*, 2*b*, to which the paper web 10 is transferred.

Felts 21, 21*a*, 21*b* are located in the second system part 2, 2*a*, 2*b*. The felts 21, 21*a*, 21*b* are guided over deflection rolls 22, 22*a*, 22*b* in the direction of the arrows. Each of the felts is intrinsically closed, or endless. In addition, press rolls 23, 23*a*, 23*b*, 23*c*, which are each assigned to one another in pairs, are provided in the system part 2, 2*a*, 2*b*. Also provided are tensioning rolls 24, 24*a*, 24*b*, over which the felts 21, 21*a*, 21*b* are guided and by means of which the felts can be tensioned.

From the first system part, the paper web 10 is transferred to the felt 21 in the second system part 2, 2*a*, 2*b*. Next, the paper web 10 arrives between the felts 21, 21*a*, with which it is pressed by means of the press rolls 23, 23*a*, as a result of which moisture in the paper web 10 is given up to the felts 21, 21*a*. Thereupon, the paper web 10 with the felt 21 passes between the press rolls 23, 23*b*, by means of which it is pressed with the felt 21. Furthermore, the paper web 10 with the felt 21*b* passes between the two press rolls 23*b*, 23*c*. Thus, moisture from the paper web 10 is given up to the felts 21, 21*a*, 21*b*.

The second system part 2, 2*a* and 2*b* is followed by a third system part 3, in which there is a plurality of drying rolls 31, over which the paper web 10 is led, by means of which it is dried further.

The paper web 10 located on the wire 11 has a dryness of about 20% at the end of the first system part 1. At the end of the second system part 2, 2*a*, 2*b*, the paper web 10 has a dryness of about 50% to 55%. In the third system part 3, the paper web 10 is brought to a dryness of about 93%.

Since it is not only moisture but also foreign materials found in the paper web 10, such as pulp fibers and other paper constituents such as fillers, resins, ash, printer's ink, that are transferred from the paper web 10 into the felts 21, 21*a*, 21*b*, there is the need to assign the felts 21, 21*a*, 21*b* apparatuses 4, 5 for cleaning the same. The structure and functionality of the cleaning apparatuses 4 and 5 is explained in the following.

Figure 2:
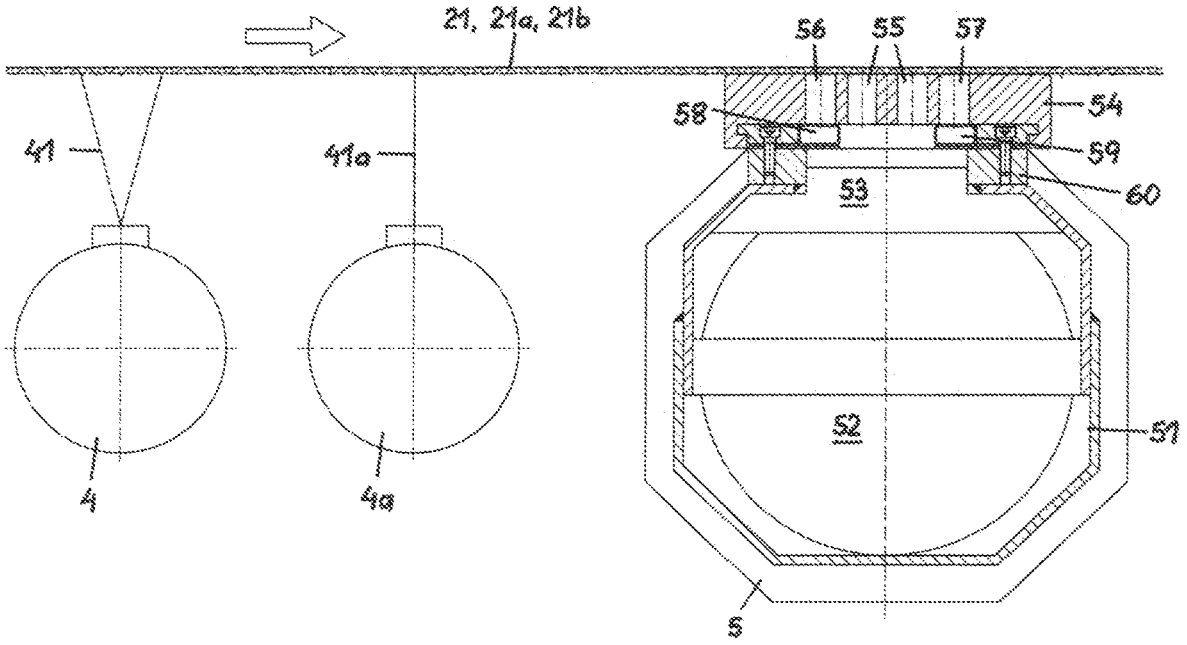
FIG. 2 shows a device, located in the system according to FIG. 1, for introducing a cleaning liquid into felts and a suction device, on a scale enlarged with respect to FIG. 1 and in cross section.

As illustrated in FIG. 2, an apparatus of this type for cleaning a felt 21, 21*a*, 21*b* has at least one spraying device 4, 4*a* for introducing a cleaning liquid into the felt 21, 21*a*, 21*b* and, following in the direction of movement of the felt 21, 21*a*, 21*b*, at least one suction device 5. In FIG. 2, a first spraying device 4, by means of which a wide jet 41*a* is applied to the felt 21, 21*a*, 21*b*, and a second spraying device 4*a*, by means of which a narrow jet 41*a* is applied to the felt 21, 21*a*, 21*b*, are illustrated. The application to the felt 21, 21*a*, 21*b* is carried out in each case over the entire width of the felt 21, 21*a*, 21*b*. The cleaning liquid is composed of water, which is possibly provided with additives such as solvents.

The suction device 5 has a housing 51 with a vacuum duct 52, in which a negative pressure of −200 millibar to −600 millibar is produced. An opening 53 is provided on the top of the housing 51 which is enclosed by a frame 60 and which is sealed off by a suction plate 54 formed with suction ducts 55, 56, 57. The felt 21, 21*a*, 21*b* is moved along the top of the suction plate 54. The suction ducts 56, 57 are assigned valve elements 58, 59, by means of which these two suction ducts 56, 57 can be closed.

The modes of action of the spraying devices 4, 4*a* and of the suction device 5 are as follows:

The felt 21, 21*a*, 21*b* is moved past the spraying devices 4, 4*a* and then past the suction device 5. By means of the spraying devices 4, 4*a*, a cleaning liquid, which penetrates into the felt 21, 21*a*, 21*b*, is applied to the felt 21, 21*a*, 21*b*. By means of the at least one suction device 5, this cleaning liquid is drawn out of the felt 21, 21*a*, 21*b* to thereby remove foreign materials from the felt 21, 21*a*, 21*b*. However, as the operating time increases, more and more proportions of foreign materials remain in the felt 21, 21*a*, 21*b*, as a result of which the latter becomes less and less permeable. For this reason, the area of the felt 21, 21*a*, 21*b* on which a suction force is exerted by the suction device 5 must be enlarged, in order to be able to carry out effective cleaning of the felt 21, 21*a*, 21*b* by means of the cleaning liquid.

This need is met in that, for the cleaning of a new and thus still very permeable felt 21, 21*a*, 21*b*, the suction ducts 56, 57 are closed by means of the valve elements 58, 59, as illustrated in FIG. 2. This ensures that the vacuum which is produced in the vacuum duct 52 and which is required to achieve the necessary suction force can be maintained. However, as soon as the permeability of the felt 21, 21*a*, 21*b* decreases on account of the foreign materials remaining in the same, which means that the cleaning force affected by the extracted cleaning liquid is reduced, the area of the suction force acting on the felt 21, 21*a*, 21*b* must be enlarged. For this purpose, the valve elements 58, 59 assigned to the suction ducts 56, 57 are brought into the open position thereof, by which means that area of the felt 21, 21*a*, 21*b* on which a suction force is exerted is enlarged.

Figure 2A:
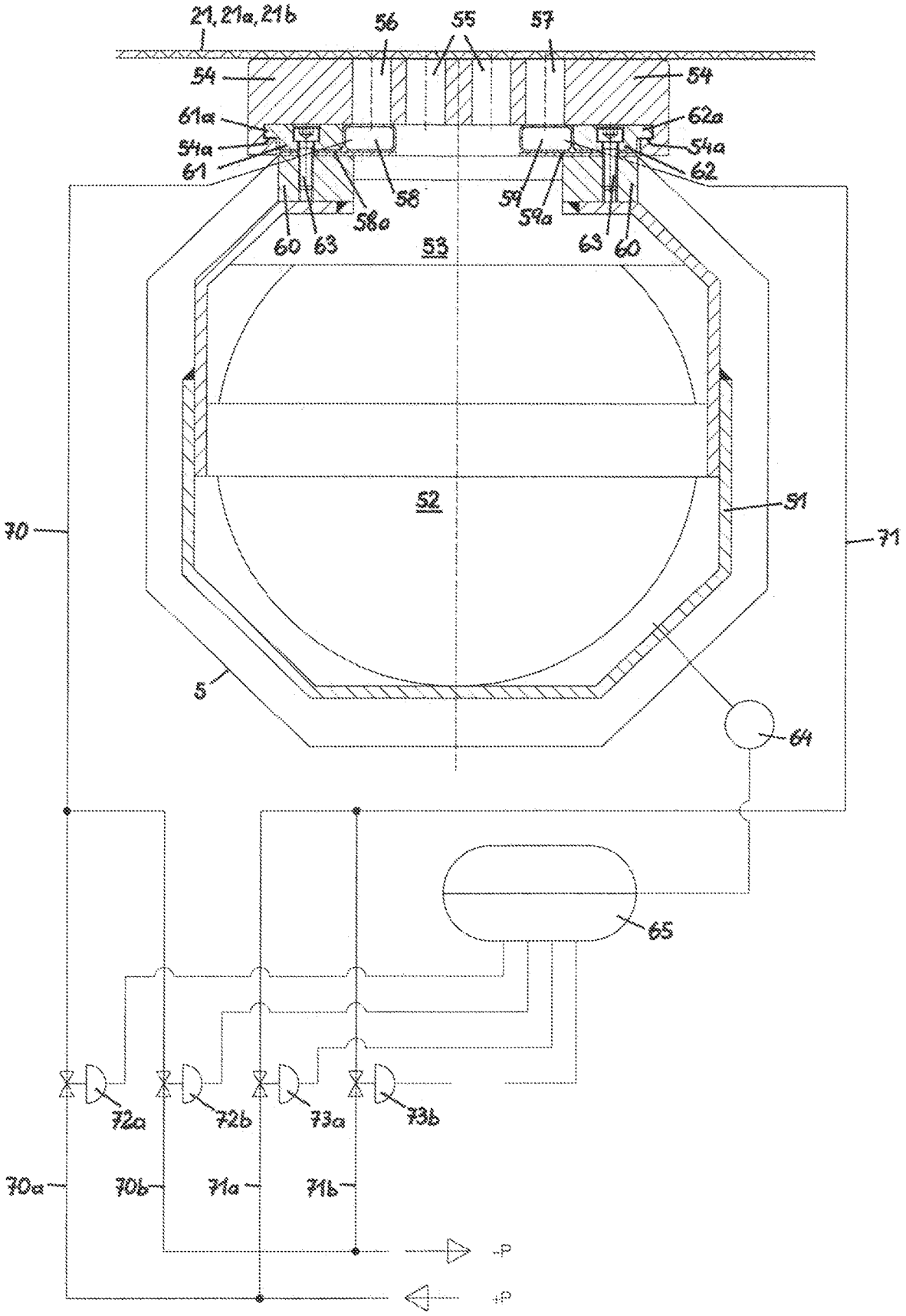
FIG. 2A shows the suction device according to FIG. 2 on a scale enlarged with respect to FIG. 2 and having a control system assigned thereto.

In the following, by using FIG. 2A, the formation of the suction device 5 and its mode of action are explained further.

The housing 51 of the suction device 5 is formed on its upper side with the frame 60, which encloses the opening 53. Provided on this frame 60 are supporting strips 61, 62 located at the side of the opening 53, which are fixed to the frame 60 by means of bolts 63. The suction plate 54 and the supporting strips 61, 62 are formed with grooves 54*a* and tongues 61*a*, 62*a* assigned to one another.

The valve elements 58, 59 are each formed by an inflatable hose, which is rectangular in cross section and which is respectively formed with a laterally projecting flap 58*a*, 59*a*, which is located between the frame 60 and the strips 61, 62, by which means the hoses 58, 59 are fixed. The inflatable hoses consist of a rubber or synthetic material, such as ethylene-propylene-diene rubber (EPDM) or of nitrile butadiene rubber (NBR).

A vacuum pump applies a vacuum to the vacuum duct 52 which is measured by a measuring device 64. The output from the measuring device 64 is led to a control device 65. The hoses 58, 59 can be connected via lines 70, 71 either to a pressurized air pump +P, by which means they are inflatable, or they can be connected to a vacuum pump −P, by means of which they can be vented. For this purpose, two lines 70*a*, 70*b* are connected to the line 70, and two lines 71*a*, 71*b* are connected to the line 71, the lines 70*a*, 71*a* being connected to the compressed air pump and the lines 70*b*, 71*b* being connected to the vacuum pump. In the lines 70*a*, 70*b* and 71*a*, 71*b* there are valves 72*a*, 72*b* and 73*a*, 73*b*, which are controlled by the control device 65. As soon as the valves 72*a*, 73*a* are opened, compressed air is applied to the hoses 58, 59 assigned to the suction ducts 56, 52. As a result, they are inflated, by which means the suction ducts 56, 57 are closed. This is necessary when the permeability of the felt 21, 21*a*, 21*b* is still so high that only the suction ducts 55 should be opened to maintain the vacuum in the vacuum duct 52, whereas the suction ducts 56, 57 must be closed.

However, as soon as the permeability of the felt 21, 21*a*, 21*b* to the cleaning liquid has been reduced as a result of the fact that foreign materials are increasingly located in the latter, for which reason that area of the felt 21, 21*a*, 21*b* on which the suction force is exerted must be enlarged, the valves 72*b*, 73*b* are opened, by which means the hoses 58, 59 are vented. In this way, the suction ducts 56, 57 are opened, by which means suction force is also applied to the felt 21, 21*a*, 21*b* through the suction ducts 56, 57.

On account of the fact that the valve elements are inflatable, being formed in particular by inflatable hoses, those suction ducts which are assigned these valve elements can be opened at any time during the operation of the system for paper production, which means that the difficulties adhering to the known prior art during the opening of further suction ducts are avoided.

Since the suction plate 54 is formed with grooves 54*a* and the supporting strips 61, 62 are formed with tongues 61*a*, 62*a* assigned to the grooves 54*a*, the suction plate 54 can be drawn out laterally, by which means the hoses 58, 59 can be mounted in a simple way.

In the following, by referring to FIG. 3, FIG. 3A, FIG. 3B, the mode of action of such a suction device 5 is explained by using a first embodiment.

Figure 3:
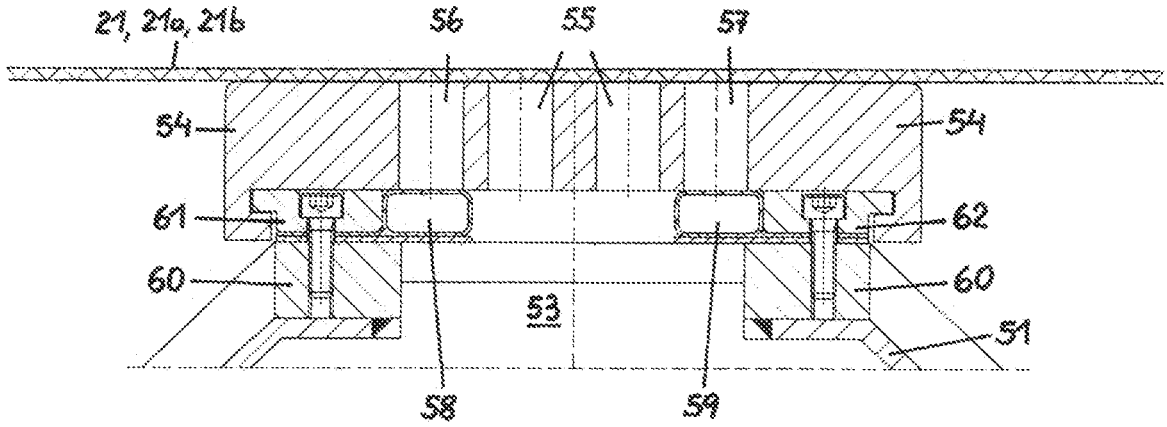
FIG. 3, FIG. 3A, FIG. 3B show vertical sections taken through a first embodiment of the suction device according to FIG. 2A on a scale reduced with respect to FIG. 2A and in three different operating positions.

According to FIG. 3, the two hoses 58, 59 have compressed air applied thereto, by which means they are inflated. In this way, the suction ducts 56, 57 are closed. This is necessary when the felt 21, 21*a*, 21*b* contains no or only few foreign materials, so it is very permeable for the extraction of the cleaning liquid.

However, as soon as the felt 21, 21*a*, 21*b* contains more and more foreign materials with increasing operating time, as a result of which its permeability to the cleaning liquid is reduced more and more, firstly the hose 58 is vented, which means the suction duct 56 is opened and a suction force is also exerted on the felt 21, 21*a*, 21*b* via said suction duct. This operating position is illustrated in FIG. 3A.

Next, the hose 59 is also vented, by which means the suction duct 57 is also opened and a suction force is also exerted on the felt 21, 21*a*, 21*b* via the suction duct 57. This operating position is illustrated in FIG. 3B.

Figure 3A:
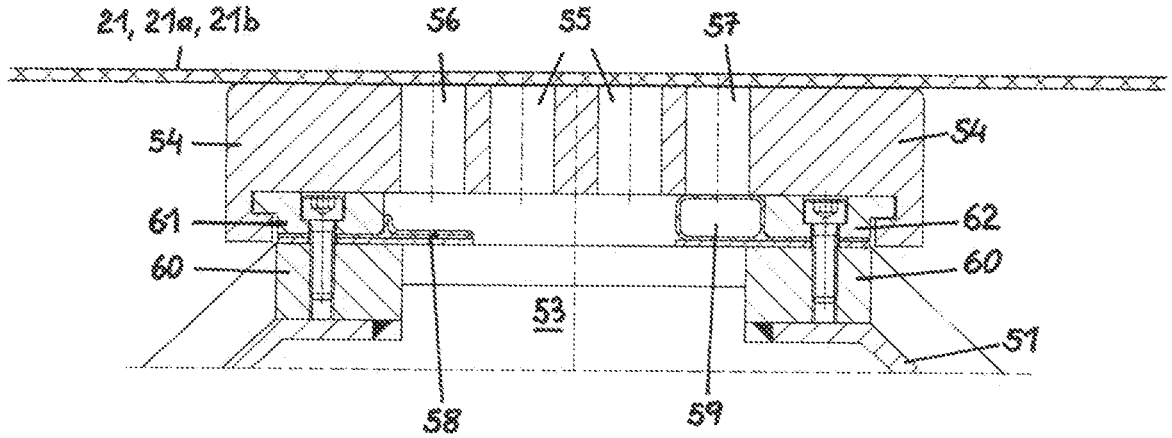
Figure 3B:
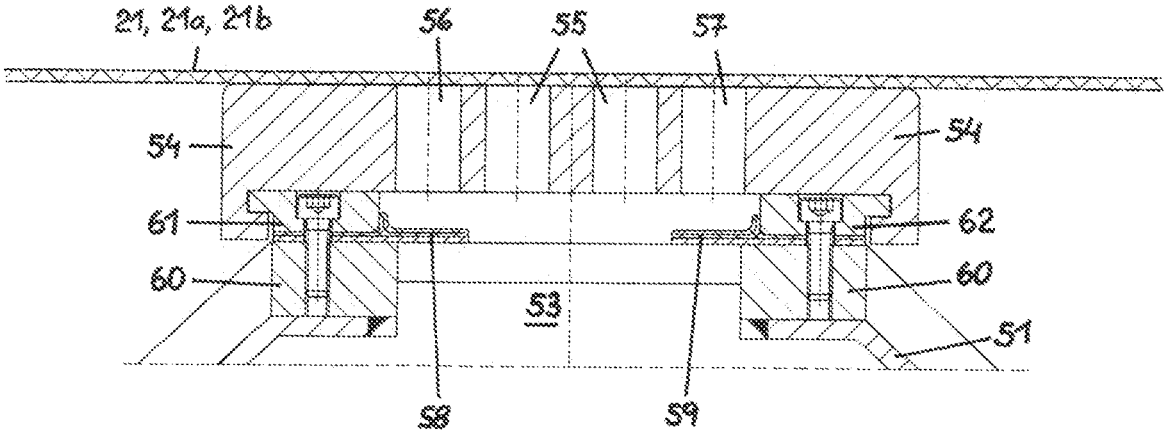
Figure 4:
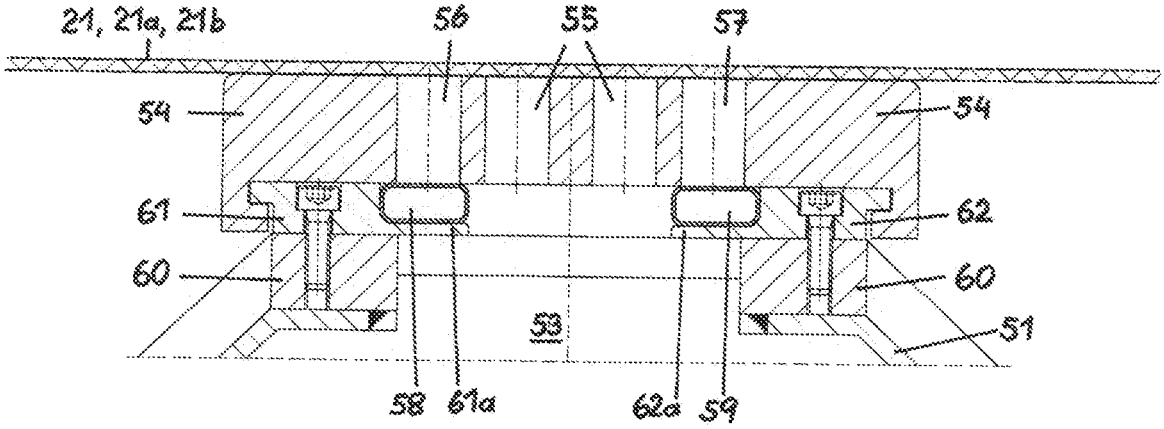
FIG. 4, FIG. 4A, FIG. 4B show vertical sections taken through a second embodiment of the suction device according to FIG. 2A on a scale reduced with respect to FIG. 2A and in three different operating positions.
Figure 4A:
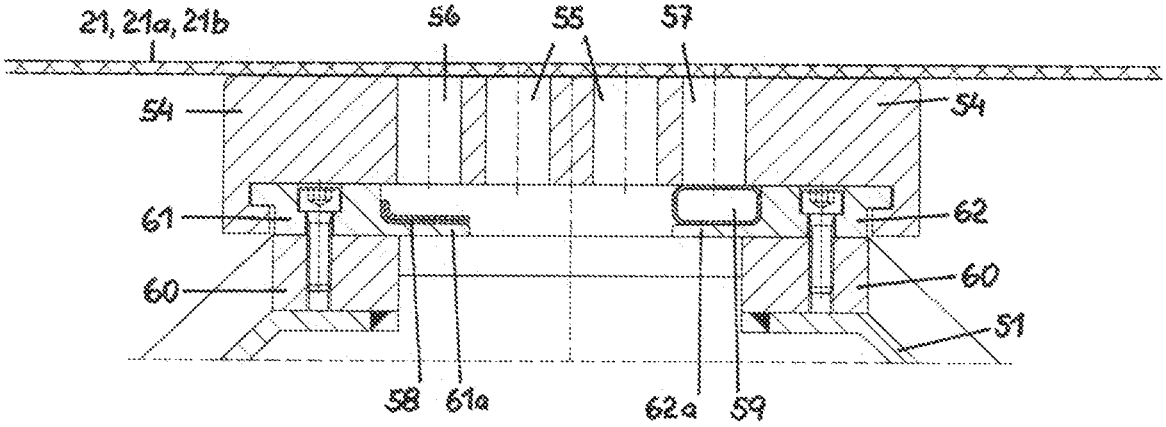
Figure 4B:
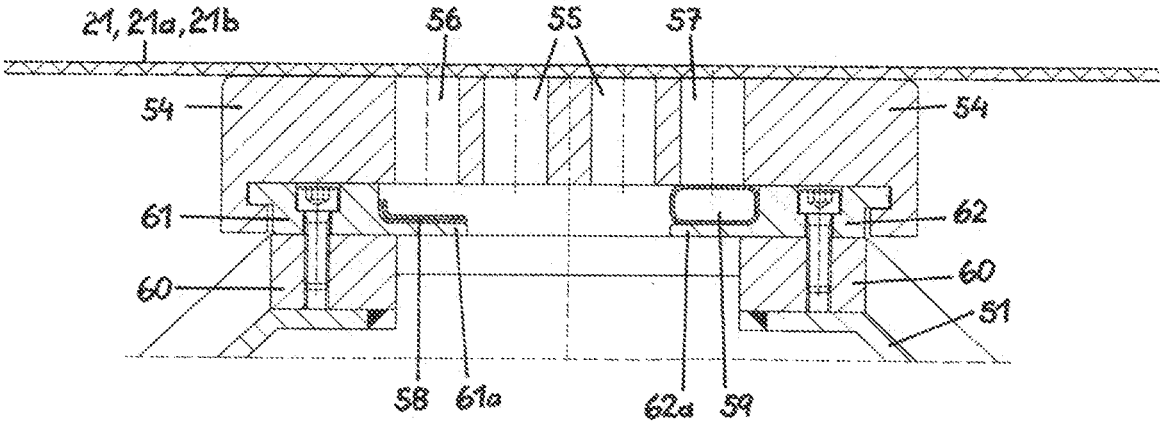

A second embodiment, changed with respect to FIG. 3, FIG. 3A, FIG. 3B, is illustrated in FIG. 4, FIG. 4A, FIG. 4B. Here, the supporting strips 61, 62 are formed with extensions 61*a*, 62*a*, to which the hoses 58, 59 are fixed, for example by adhesive bonding with an adhesive.

The mode of action of the hoses 58, 59 and the modes of operation thereof are the same as explained by using FIG. 3, FIG. 3A, FIG. 3B.

Figure 5:
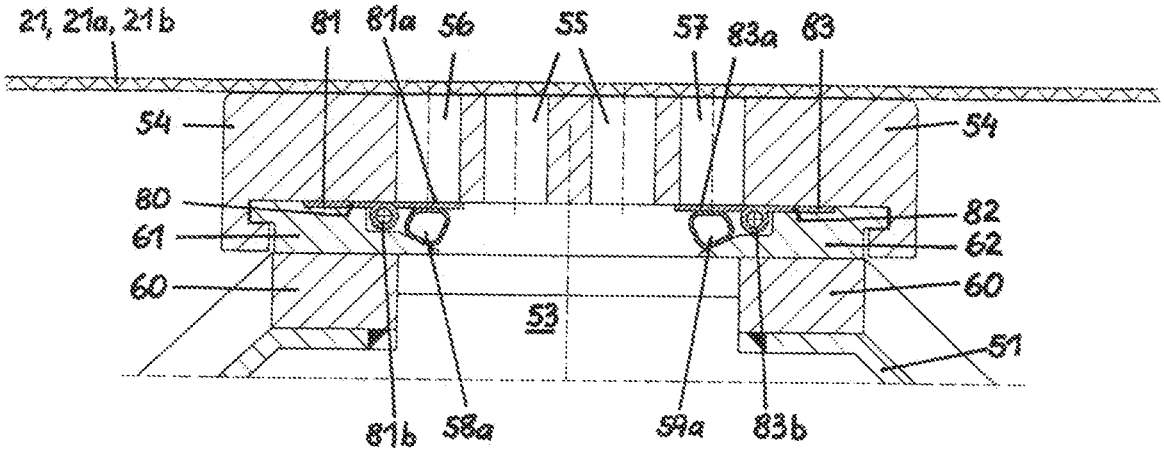
FIG. 5, FIG. 5A, FIG. 5B show vertical sections taken through a third embodiment of the suction device according to FIG. 2A on a scale reduced with respect to FIG. 2A and in three different operating positions.
Figure 5A:
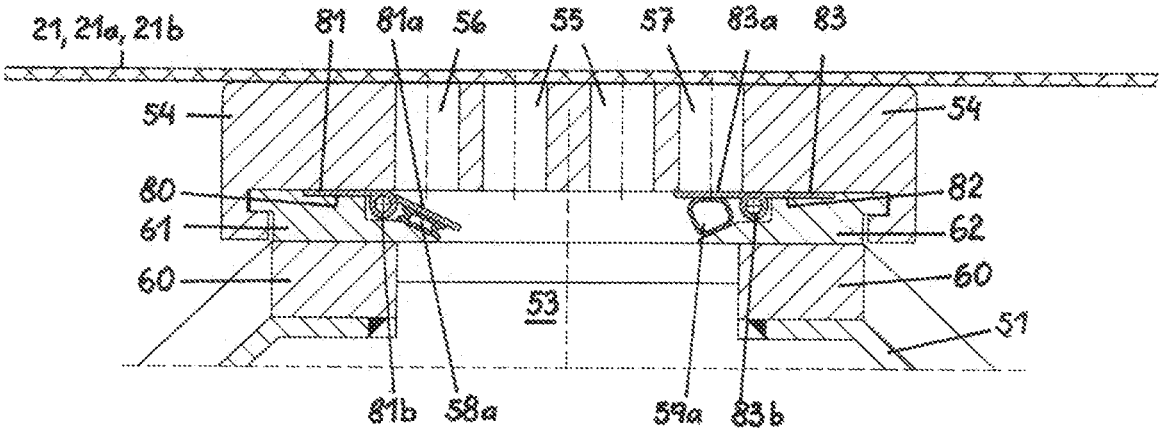
Figure 5B:
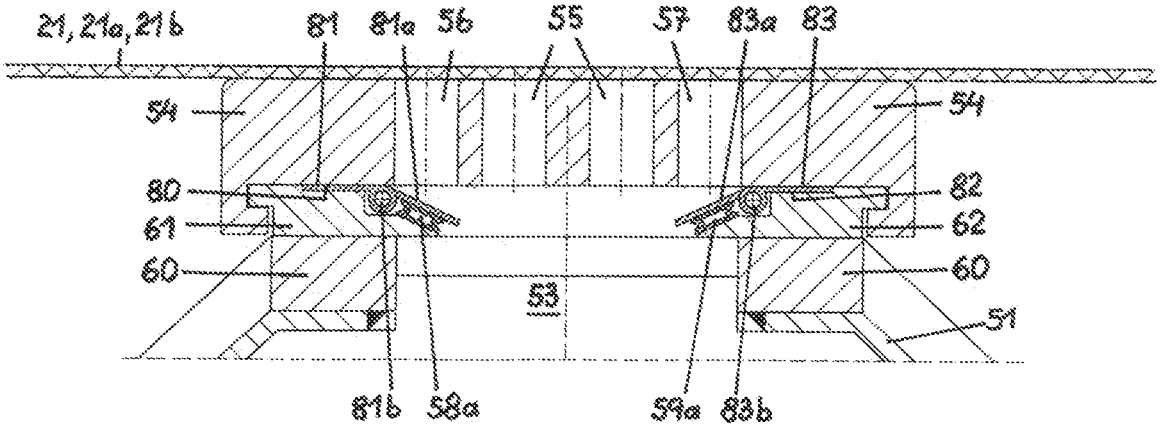

In the following, by using FIG. 5, FIG. 5A, FIG. 5B, a third embodiment in the formation of the hoses acting as valve elements is explained. Here, between the suction plate 54 and the supporting strips 61, 62 there are hinge-like elements 80, 82, each having two plates 81, 81*a* and 83, 83*a*, which are mounted on axle bolts 81*b*, 83*b*. The plates 81, 83 are located between the suction plate 54 and the supporting strips 61, 62 and are fixed in this way. The plates 81*a*, 83*a* are pivotable with respect to the plates 81, 83. Between the plates 81*a*, 83*a* and the supporting strips 61, 62 there are hoses 58*a*, 59*a*. If the hoses 58*a*, 59*a* are inflated, the plates 81*a*, 83*a* rest on the suction plate 55, by which means the suction ducts 56, 57 are closed. As soon as the hoses 58*a*, 59*a* are vented, the plates 81*a*, 83*a* are lifted off the suction plate 55, by which means the suction ducts 56, 57 are opened.

The suction ducts located in the suction plate 55 can be formed by slots extending over the widths of the felts, by a plurality of slots which, overall, extend over the widths of the felts, or by a plurality or a multiplicity of openings, in particular drilled holes, which are arranged over the widths of the felts. Some of these suction ducts are assigned inflatable valve elements, in particular in the form of hoses, by means of which individual suction ducts can be opened.

The particular advantage of such an apparatus consists in the fact that, on account of the inflatable and deflatable valve elements which are assigned to the suction ducts located in the suction plate, it is possible to open the suction ducts during the operation of the system, in order to be able to apply suction force to enlarged areas of the felts. In this way, it is not necessary to provide a further suction device which is connected as the loading of the felts with foreign materials rises.

The invention claimed is:

1. An apparatus for cleaning a felt in a system for producing a paper web, the apparatus comprising:

a device for introducing a cleaning liquid into the felt;

at least one suction device disposed downstream of said device in a direction of movement of the felt, said suction device having a vacuum duct, through which the cleaning liquid is suctioned out of the felt;

said suction device having suction ducts formed therein between said vacuum duct and the felt for suctioning the cleaning liquid away from the felt; and an inflatable valve element assigned to at least one of said suction ducts said at least one of said suction ducts being selected from the group consisting of:

at least one slot oriented transversely with respect to the direction of movement of the felt and extending over a width of the felt, a plurality of slots oriented transversely with respect to the felt, adjoining one another and extending as a whole over the width of the felt, and a plurality of individual bore holes arranged over the width of the felt;

said inflatable valve element being an inflatable hose extending along the at least one slot, plurality of slots, or the plurality of bore holes;

said inflatable valve element having an inflated state in which the at least one slot, the plurality of slots or the plurality of bore holes is closed individually; and said inflatable valve element having a ventilated state in which the at least one slot, the plurality of slots or the plurality of bore holes is opened individually.

2. The apparatus according to claim 1, wherein said at least one of said suction ducts is the at least one slot.

3. The apparatus according to claim 1, wherein said at least one of said suction ducts is the plurality of slots.

4. The apparatus according to claim 1, wherein said suction ducts are individual openings.

5. The apparatus according to claim 4, wherein said suction ducts are bore holes.

6. The apparatus according to claim 1, which comprises at least one suction plate affixed to said suction device, said at least one suction plate having said suction ducts formed therein and extending transversely with respect to the felt.

7. The apparatus according to claim 6, wherein said inflatable valve element is formed with a projecting strip that is clamped between a housing of said vacuum duct and said suction plate.

8. The apparatus according to claim 6, which comprises at least one supporting strip for said inflatable valve element disposed between a housing of said vacuum duct and said suction plate, wherein said valve element is fixed to said supporting strip.

9. The apparatus according to claim 8, wherein said inflatable valve element is fixed to said supporting strip by adhesive bonding.

10. The apparatus according to claim 8, which comprises at least one valve plate supported on said supporting strip and having said inflatable valve element affixed thereto, said at least one valve plate being adjustable by said inflatable valve element to be pivoted by said inflatable valve element into the position closing the associated said suction opening.

11. The apparatus according to claim 8, wherein said supporting strip is screwed to a housing of said vacuum duct, and wherein said suction plate and said supporting strips are formed with grooves and tongues assigned to one another and affixing said suction plate and said supporting strip to each other.

12. The apparatus according to claim 11, wherein said grooves and said tongues are oriented transversely with respect to the felt, and wherein said suction plate is displaceable transversely with respect to the felt.

* * * * *